US007728500B2

(12) United States Patent
Ogasawara et al.

(10) Patent No.: US 7,728,500 B2
(45) Date of Patent: Jun. 1, 2010

(54) ELECTRODELESS DISCHARGE LAMP

(75) Inventors: Hiroshi Ogasawara, Yawata (JP); Hidenori Kakehashi, Takatsuki (JP); Ryusuke Ura, Hirakata (JP); Hiroshi Miyasaki, Tsubame (JP); Keisuke Harada, Himeji (JP); Yoshinobu Shibata, Himeji (JP); Shigeki Matsuo, Kadoma (JP); Kazuhiko Sakai, Kadoma (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 564 days.

(21) Appl. No.: 11/571,208

(22) PCT Filed: Nov. 24, 2004

(86) PCT No.: PCT/JP2004/017420

§ 371 (c)(1),
(2), (4) Date: Feb. 15, 2007

(87) PCT Pub. No.: WO2006/001091

PCT Pub. Date: Jan. 5, 2006

(65) Prior Publication Data

US 2007/0262730 A1 Nov. 15, 2007

(30) Foreign Application Priority Data

Jun. 25, 2004 (JP) ..... 2004-188769
Jun. 25, 2004 (JP) ..... 2004-188792

(51) Int. Cl.
*H01J 1/62* (2006.01)

(52) U.S. Cl. ..... 313/492; 313/153

(58) Field of Classification Search ..... 313/153, 313/318.01–318.1, 492
See application file for complete search history.

(56) References Cited

U.S. PATENT DOCUMENTS 5,130,912 A 7/1992 Friederichs et al.

(Continued)

FOREIGN PATENT DOCUMENTS

JP 53-90677 8/1978

(Continued)

OTHER PUBLICATIONS

English language Abstract of JP 7-211298, published Aug. 11, 1995.

(Continued)

*Primary Examiner*—Nimeshkumar D Patel
*Assistant Examiner*—Mary Ellen Bowman
(74) *Attorney, Agent, or Firm*—Greenblum & Bernstein, P.L.C.

(57) ABSTRACT

In an electrodeless discharge lamp suitable for use at a place with unfavorable environmental conditions or at a place where lamp replacement is difficult, the replacement of a lamp unit is facilitated and the lamp unit is prevented from falling off from a power coupler unit even if there is component deterioration caused by long-term use. A metallic elastic member is provided near a position on a metallic heat conduction member of the power coupler unit that is farthest from an electromagnetic field generating portion. In addition to an ordinary coupling structure between the power coupler unit and a coupling member, the elastic member is engaged with the coupling member of the lamp unit. When the lamp unit is mounted on or removed from the power coupler unit, a bulb of the lamp unit is turned relative to the power coupler unit about the axis and moved forward/backward in the direction of the axis. This causes the elastic member to be elastically deformed by the coupling member and engaged to or separated from a coupling portion provided at the coupling member.

10 Claims, 13 Drawing Sheets

U.S. PATENT DOCUMENTS

| | | | | |
|---|---|---|---|---|
| 5,211,472 | A | 5/1993 | Friederichs et al. | |
| 5,461,284 | A | 10/1995 | Roberts et al. | |
| 5,668,433 | A | 9/1997 | Everest et al. | |
| 5,934,791 | A | 8/1999 | Van Gennip et al. | |
| 6,121,730 | A | 9/2000 | Ukegawa et al. | |
| 2002/0158567 | A1 * | 10/2002 | Arakawa et al. | 313/492 |
| 2003/0132706 | A1 | 7/2003 | Itaya et al. | |

FOREIGN PATENT DOCUMENTS

| | | |
|---|---|---|
| JP | 62-66162 | 4/1987 |
| JP | 4-230948 | 8/1992 |
| JP | 4-319250 | 11/1992 |
| JP | 7-211298 | 8/1995 |
| JP | 7-250940 | 10/1995 |
| JP | 8-212981 | 8/1996 |
| JP | 8-511650 | 12/1996 |
| JP | 11-508404 | 7/1999 |
| JP | 2003-031004 | 1/2003 |
| JP | 2003-257379 | 9/2003 |
| JP | 2004-119038 | 4/2004 |
| WO | 95/27995 | 10/1995 |
| WO | 97/40512 | 10/1997 |

OTHER PUBLICATIONS

English language Abstract of JP 4-319250, published Nov. 10, 1992.
English language Abstract of JP 2003-257379, pub Sep. 12, 2003.
English language Abstract of JP 2003-31004, pub Jan. 31, 2003.
English language Abstract of JP 8-212981, pub Aug. 20, 1996.
English language Abstract of JP 4-230948, pub Aug. 19, 1992.
English language Abstract of JP 7-250940, pub Oct. 3, 1995.
English language Abstract of JP 2004119038, pub Apr. 15, 2004.
U.S. Appl. No. 10/576,710 to Kakehashi et al., filed Apr. 21, 2006.

* cited by examiner a' < a b' < b

ELECTRODELESS DISCHARGE LAMP

TECHNICAL FIELD

The present invention relates to an electrodeless discharge lamp that has no electrode in a bulb into which a discharge gas is filled, generates a high-frequency electromagnetic field by applying electric current to a coil, and thereby excites the discharge gas in the bulb so as to emit light.

BACKGROUND ART

Typically, an electrodeless discharge lamp is comprised of a lamp unit, a power coupler unit (inductive coil device), and so on, and excites a discharge gas contained in the bulb (discharge container) by applying a high-frequency electromagnetic field to the discharge gas, and thereby emitting light. Since no electrode is provided in a bulb of the electrodeless discharge lamp, it has a long life as compared to a discharge lamp having an electrode in the bulb. Further, by appropriately selecting the type and pressure of the discharge gas to be contained in the bulb, the strength of the high-frequency magnetic field, and so on, a high-efficiency electrodeless discharge lamp can be achieved.

Due to the high efficiency and the long life, an electrodeless discharge lamp is especially advantageous in the case where it is used at a place that requires a high efficiency as well as making it difficult to replace the lamp unit such as for illumination at the ceiling of a theater or an entrance hall or for illumination at a road.

For example, FIG. 14 shows a configuration of a conventional electrodeless discharge lamp disclosed in International Publication No. WO97/40512 or Japanese Laid-open Patent Publication No. 2004-119038. This conventional electrodeless discharge lamp is comprised of a lamp unit 1 and a power coupler unit 2, in which a coil is wound in a substantially cylindrical cavity (hollow portion) 11 formed at the center of the lamp unit 1. The lamp unit 0 comprises a bulb (airtight container) 10 having the above described cavity 11, a coupling member (collar) 30 that is made of a synthetic resin for fixing the bulb 10 to the power coupler unit 2, and so on. For example, an ionized enclosure having a rare gas is contained in the bulb 10. On the other hand, the power coupler unit 2 comprises the coil 20, a soft magnetic core 21, a heat conduction member 22, a mounting member 31 made of a synthetic resin to be coupled with the coupling member 30, and so on.

The coupling member 30 and the mounting member 31 are precisely formed of a synthetic resin and have a number of complex shaped fitting portions 31*a*, 31*b*, 31*c*, 31*d*, 31*e* . . . . These fitting portions 31*a*, 31*b*, 31*c*, 31*d*, 31*e* . . . allow the lamp unit 1 to be attached on and detached from the power coupler unit 2 as well as allowing the lamp unit 1 to be securely held so as not to become easily detached from the power coupler unit 2 while the lamp unit 1 is mounted on the power coupler unit 2.

However, since the coupling member 30 and the mounting member 31 are made of the synthetic resin as described above, they may deteriorate gradually during long-term use depending on environmental conditions and thus may have looseness, deformation, wear, defect, and so on at the respective fitting portions. Especially when it is used, for example, in a high-temperature environment, at a place with much ultraviolet radiation from the lamp unit itself or sunlight, or at a place where heavy vibrations may occur such as on a road or an iron bridge, the coupling member 30 and the mounting member 31 may seriously deteriorate. Consequently, in such a case where the electrodeless discharge lamp is used on a ceiling for example, there is a possibility that the lamp unit 1 may be detached from the power coupler unit 2 because the coupling structure between the coupling member 30 and the mounting member 31 cannot maintain the coupling power sufficient for the weight of the lamp unit 1. Therefore, it is needed to prevent the lamp unit 1 from accidental detachment from the power coupler unit 2 in long-term use.

Further, since the electrodeless discharge lamp is often used at a place where replacement of the lamp unit is difficult, the workability in mounting is particularly important. Therefore, the lamp unit is required to be easily replaceable even when a worker performs the replacement by touch. Since the conventional electrodeless discharge lamp has a number of intricately shaped fitting portions 31*a*, 31*b*, 31*c*, 31*d*, 31*e* . . . on the coupling member 30 and the mounting member 31, it is not always easy to replace the lamp unit 1.

DISCLOSURE OF INVENTION

The present invention has been made to solve the above described problems in the prior art, and an object of the invention is to provide an electrodeless discharge lamp that is suitable for use at a place with unfavorable environmental conditions or at a place where lamp replacement is difficult.

An electrodeless discharge lamp in accordance with an aspect of the present invention comprises a power coupler unit and a lamp unit detachably attached to the power coupler unit, wherein the lamp unit further comprises: a discharge container that is made of a light transparent material, has a substantially tubular hollow portion in a vicinity of a central area thereof, and into which a discharge gas is filled therein; and a coupling member that is fixed on the discharge container in a vicinity of an opening of the hollow portion and has a first coupling portion to be coupled with the power coupler unit, and the power coupler unit further comprises: an electromagnetic field generator that is fitted into the hollow portion of the discharge container to generate a high-frequency electromagnetic field; a heat conduction member made of a metallic material to radiate heat generated in the electromagnetic field generator; a second coupling portion to be coupled with the first coupling portion of the coupling member; and a metallic elastic member provided in a vicinity of a position on the heat conduction member that is farthest from the electromagnetic field generator so as to be engaged with a portion of the coupling member other than the first coupling portion.

With such a configuration, the coupling member is to be engaged with the metallic elastic member relatively less likely to deteriorate even after long-term use under unfavorable environmental conditions. Accordingly, even if the coupling force of the lamp unit and the power coupler unit is decreased due to deterioration of the first coupling portion and the second coupling portion, it is possible to prevent the accidental detachment of the lamp unit from the power coupler unit. Furthermore, since the elastic member is provided in the vicinity of the position on the heat conduction member farthest from the electromagnetic field generator, it is possible to reduce an affect by an electric field or magnetic field. Still furthermore, since the lamp unit can be attached to the power coupler unit only by at least moving the lamp unit toward the power coupler unit, a worker can perform the work operation even by touch, and thereby the workability in the attachment is excellent.

BEST MODE FOR CARRYING OUT THE INVENTION

First Embodiment

Figure 1:
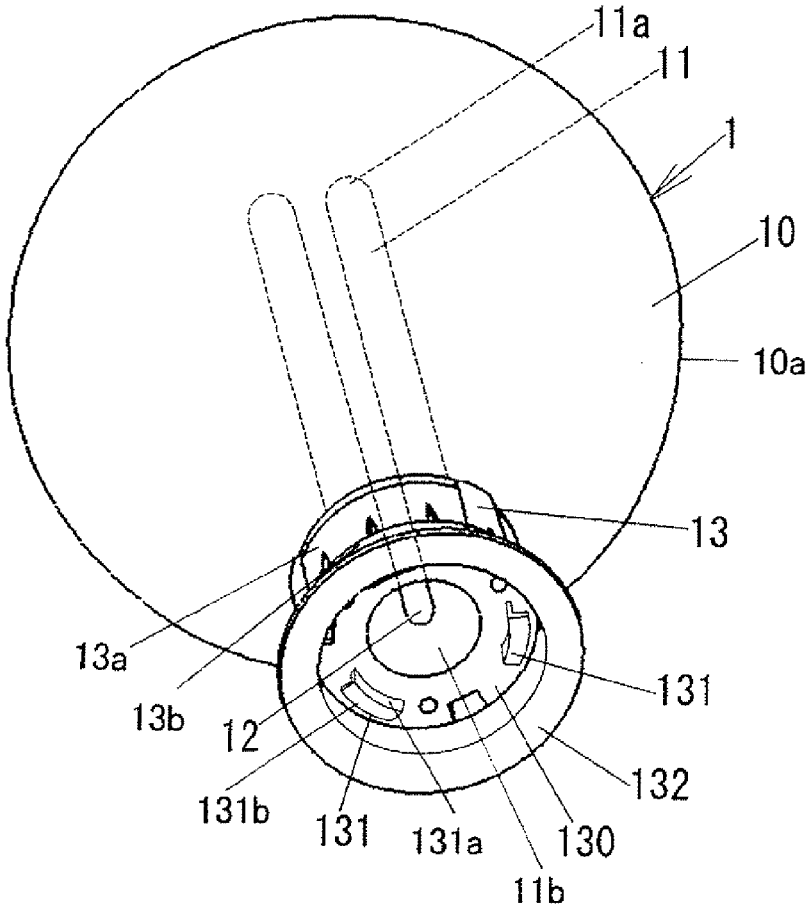
FIG. 1 is a perspective view of an electrodeless discharge lamp in accordance with a first embodiment of the present invention, in a state where a lamp unit is separated from a power coupler unit.
Figure 1:
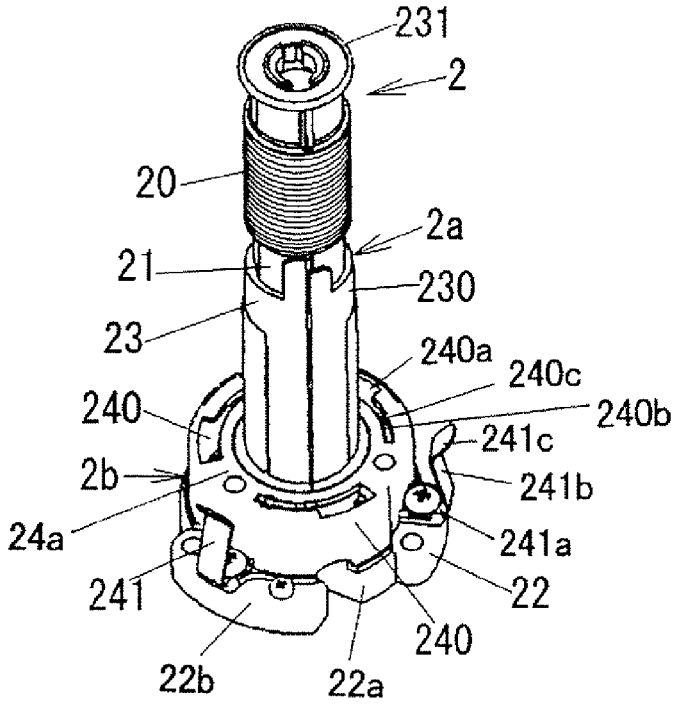

A basic configuration of an electrodeless discharge lamp in accordance with a first embodiment of the present invention is described with reference to FIG. 1 and FIG. 3. The electrodeless discharge lamp in accordance with the first embodiment is comprised of a lamp unit 1 and a power coupler unit 2 so that the lamp unit 1 is detachably attached to the power coupler unit 2. The lamp unit 1 comprises a bulb (discharge container) 10 and a coupling member (collar) 13.

The bulb 10 has an outer portion 10*a* that is made of a light transparent material such as a glass so as to have a rotationally symmetrical shape such as a substantially spherical shape, a cavity (hollow portion) 11 that is shaped like a tube with a bottom and disposed about the rotational symmetry axis within the outer portion, an air pipe 12 that is disposed about the rotational symmetry axis at the center of the inside of the cavity 11 and communicates with the inside of the bulb 10 at the bottom 11*a* of the cavity 11, and so on. After the light transparent material has been formed into a container of a predetermined shape (semifinished product for the bulb 10), air in the container is sucked out via the air pipe 12, so that once the container has been substantially evacuated. After that, a discharge gas is filled into the inside of the container via the air pipe 12. Then, by sealing the air pipe 12, the bulb 10 is completed. Hereinafter, it is to be noted that the open side of the cavity 11 of the bulb 10 is referred to as a fixed portion.

The inner surface of the outer portion 10*a* of the bulb 10 is coated with a fluorescent material and a protection film. When a high-frequency electromagnetic field is generated in a vicinity of the bulb 10, the discharge gas is ionized by the high-frequency electromagnetic field to generate electrons. The electrons collide with the atoms of the discharge gas, and thereby, the discharge gas is further ionized to generate new electrons. The electrons generated in this way receive energy from the high-frequency electromagnetic field and collide with the atoms of the discharge gas to provide them with energy. According to such collisions, the atoms of the discharge gas repeats excitation and relaxation, so that light having a given wavelength, such as ultraviolet light, is generated when excited atoms are relaxed. The fluorescent material is excited by the ultraviolet light to emit visible light. As for the discharge gas, ionizable gases including mercury, a rare gas, a metal halide and so on are usable. It is to be noted that the discharge gas is not limited to these but other gas or metal gas can be used.

The coupling member 13 is formed by molding a resin for example, and has a shape that two of a first cylindrical portion 13*a* and a second cylindrical portion 13*b*, each of which has different inner diameter and outer diameter, are stacked. A circular outward flange 132 is formed on an end portion of the second cylindrical portion 13*b* at a side of the power coupler unit 2 which has a larger inner diameter and a larger outer diameter. A circular inward flange 130 is formed on a joint face of the first cylindrical portion 13*a* and the second cylindrical portion 13*b* of the coupling member 13, and inner peripheral portion of the inward flange 130 is communicated with the cavity 11 of the bulb 10. Furthermore, a plurality of engaging protrusions (first coupling portions) 131, which protrudes toward the power coupler unit 2, is formed on the inward flange 130. A fixing structure (not shown, see, for example, FIG. 10), which is coupled with the bulb 10 thereby the bulb 10 being fixed, is further provided on the first cylindrical portion 13*a* of the coupling member 13 having a smaller inner diameter and a smaller outer diameter.

Each of the engaging protrusions 131 is comprised of a base portion 131*a* which protrude toward the power coupler unit 2 perpendicularly from the inward flange 130, i.e., in a direction parallel to the rotational symmetry axis of the bulb 10, and a protruded portion 131*b*, which outwardly protrudes parallel to the inward flange 130 from an end of the base portion at a side of the power coupler unit 2. Each of the engaging protrusions 131 has a substantially L-shaped cross section in any plane including the rotational symmetry axis of the bulb 10. Each of the engaging protrusions 131 is fitted into an engaging slot (second coupling portion) 240 which is provided on an attaching member 24 described later, thereby the lamp unit 1 is attached to the power coupler unit 2. The outward flange 132 is clipped or caught by an elastic member 241 described later, when the lamp unit 1 is attached to the power coupler unit 2. The shape of the engaging protrusion 131 is not necessarily limited to this shape, and therefore, it may be configured so that a width of the base portion thereof is narrower than that at the front end thereof in a direction perpendicular to the rotation direction.

The power coupler unit 2 is a portion of the electrodeless discharge lamp that is to be fixed on, for example, a ceiling of a building, and so on, and comprised of an insertion portion 2*a* which is to be inserted relatively into the cavity 11 of the bulb 10 and a base portion 2*b* which is to be coupled with the coupling member 13 of the lamp unit 1. When inserting the insertion portion 2*a* of the power coupler potion 2 into the cavity 11 of the bulb 10 and applying a high-frequency current to a coil 20 from a high-frequency power supply (not shown) including a lighting circuit, a high-frequency electromagnetic field is generated in the bulb 10. Then, the discharge gas is excited by the high-frequency electromagnetic field, so that the lamp unit 1 emits light. The frequency of the high-frequency electromagnetic field is not particularly limited but can be appropriately selected depending on the purpose. In this embodiment, the frequency of the high-frequency electromagnetic field is 135 kHz.

Figure 2:
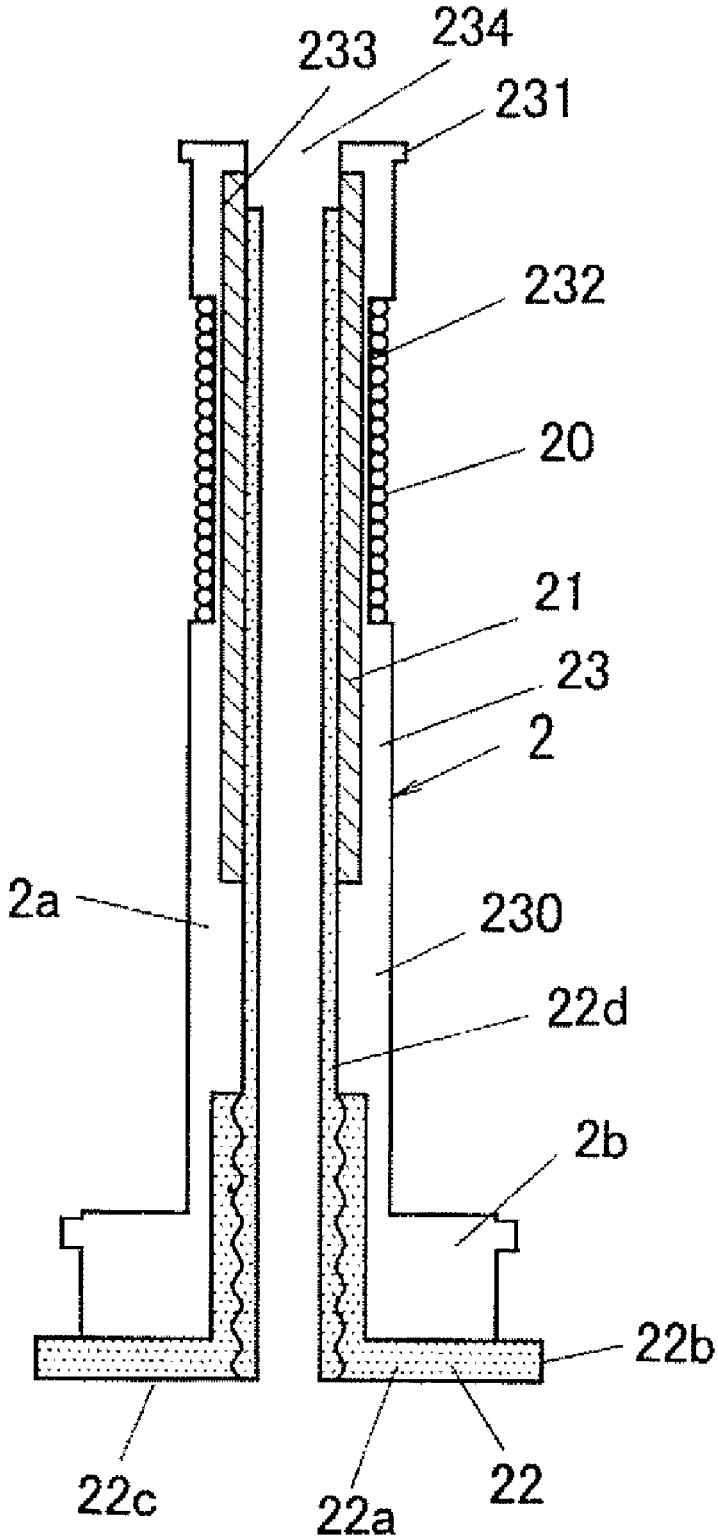
FIG. 2 is a cross sectional view showing a configuration of the power coupler unit in the electrodeless discharge lamp in accordance with the first embodiment.

As shown in FIG. 2, the insertion portion 2*a* is substantially cylindrical and comprises the coil 20 and a core 21 (electromagnetic field generator) for generating a high-frequency electromagnetic field. The coil 20 is formed by winding several turns of conductive wire of; for example, copper or copper alloy around a bobbin 23. The base portion 2*b* has a heat conduction member 22 made of an anticorrosive or a stainless metal material, the attaching member 24 fitted thereon, and so on. The bobbin 23 is formed by, for example, resin molding and disposed across the insertion portion 2*a* and the base portion 2*b*.

The core 21 is made of a material having a good high-frequency magnetic property such as a soft magnetic material, and is configured to be substantially tubular by aligning, two pairs of strips having, for example, a crescent cross section in an axial direction of the insertion portion 2*a*, so that the concave sides of the strips face each other. The core 21 is disposed on a main body 230 of the bobbin 23 described later, so that a part of an inner surface (concave face) thereof is contacts with a part of the heat conduction member 22. As for a material of the core 21, for example, Mn—Zn ferrite or NiZn ferrite can be used. Note that the core 21 is not limited to the above mentioned configuration or shape as long as it allows efficient generation of a high-frequency electromagnetic field from the coil 20. As for the core 21, a single tubular piece may be used, or it may be configured with a number of pieces different from the above, for example.

The main body 230 of the bobbin 23 is substantially tubular, and a recessed portion 232, around which the coil 20 is wound, is formed on an outer periphery thereof, and a recessed portion 233, in which the core 21 is fitted and held, is formed on an inner periphery. A through hole 234, into which the air pipe 12 of the bulb 10 is inserted, is formed at an end of the main body 230 of the bobbin 23 opposite to the base portion 2*b*. Thereby, when the lamp unit 1 is attached to the power coupler unit 2, the air pipe 12 is positioned at the center of the through hole of the main body 230. A circular flange 231, which protrudes outward in a direction perpendicular to the central axis of the tubular shape of the main body 230, is further formed at a front end of the main body 230. An outer diameter of the flange 231 is set to be smaller by a predetermined tolerance than a diameter of an inner surface of the cavity 11 of the bulb 10 facing the air pipe 12, and thereby, a misalignment between the central axis of the cavity 11 and the central axis of the power coupler unit 2 is reduced.

The heat conduction member 22 is made of a metallic material with high heat conductivity such as aluminum, copper, or their alloy. As shown in FIG. 1 to FIG. 3, the heat conduction member 22 is comprised of a fixing portion 22*c* which is configured with a disc-shaped portion 22*a* having a diameter about twice as large as the outer diameter of the bobbin 23 and a plurality of arc-shaped protrusions 22*b* formed to protrude outward from the disc-shaped portion 22*a*, and is fixed on, for example, a ceiling of a building by means of a screw or the like, and a substantially cylindrical shaped contact portion 22*d* which is formed to be perpendicular to the fixing portion 22*c* and has a surface contact with the core 21 held on the inner periphery of the main body 230 of the bobbin 23. When applying a high-frequency current to the coil 20, eddy currents occur in the core 21. Then, since the core 21 itself acts as a resistance to the eddy currents, heat is generated in the core 21. However, the heat generated in the core 21 is conducted to the ceiling of the building and so on through the heat conduction member 22, and thereby, the core 21 is cooled.

An elastic member 241, which is formed by processing an anticorrosion or a stainless metal peace having elasticity into a predetermined shape, is secured on each of the protrusions 22*b* of the heat conduction member 22 with a screw or the like. The elastic member 24*l* is made of a material resistant to metal fatigue so as to function as a plate spring. In the first embodiment, the elastic member 24*l* has a bottom face 241*a* secured to each of the protrusion 22*b* of the heat conduction member 22, a first inclined surface 241*b* bent toward the insertion portion 2*a* side (inside) at an angle of 90 degrees or more with respect to the bottom face 241*a*, and a second inclined surface 241*c* bent toward the side opposite to the insertion portion 2*a* (outside) at an angle close to 90 degrees with respect to the first inclined surface. In other words, a plurality of the elastic members 241 is provided radially with respect to the central axis of the bobbin 23 so as to be elastically deformed in a plane including the central axis of the bobbin 23 and come in contact with the outer surface of the coupling member 13 by the elasticity.

The attaching member 24 is formed by, for example, resin molding so as to be cylindrical with a diameter about twice as large as the outer diameter of the bobbin 23, and is fitted to and fixed on the disc-shaped portion 22*a* of the heat conduction member 22. Furthermore, a circular opening, through which the main body 230 of the bobbin 23 penetrates, is provided at the center portion of an end face 24*a* of the mounting member 24. Still furthermore, a plurality of openings 240, to which the respective engaging protrusions 131 of the coupling member 13 are fitted when the lamp unit 1 is attached to the power coupler unit 2, is formed around the circular opening on the end face 24*a*. As shown in FIG. 1, the opening 240 is constituted with a first slot portion 240*a* having a wide width through which the protruded portion 131*b* of the engaging protrusion 131 can completely penetrate and a second slot portion 240*b* having a narrow width to be engaged with the base portion 131*a*. Furthermore, a small protrusion 240*c* is formed to protrude inwardly on a side face of the second slot portion 240*b* of the opening 240, and a recessed portion (not shown) is formed to engage with the small protrusion is formed on the base portion 131*a* of the engaging protrusion 131. Thereby, when the lamp unit 1 is attached to the power coupler unit 2, a worker can feel a click feeling. In other words, in the first embodiment, when moving the lamp unit 1 toward the power coupler unit 2 under a state where the cavity 11 of the lamp unit 1 faces the bobbin 23 of the power coupler unit 2, the main body 230 of the bobbin 23 is fitted to the cavity 11 and the elastic member 241 is engaged with the coupling member 13, simultaneously.

Figure 3A:
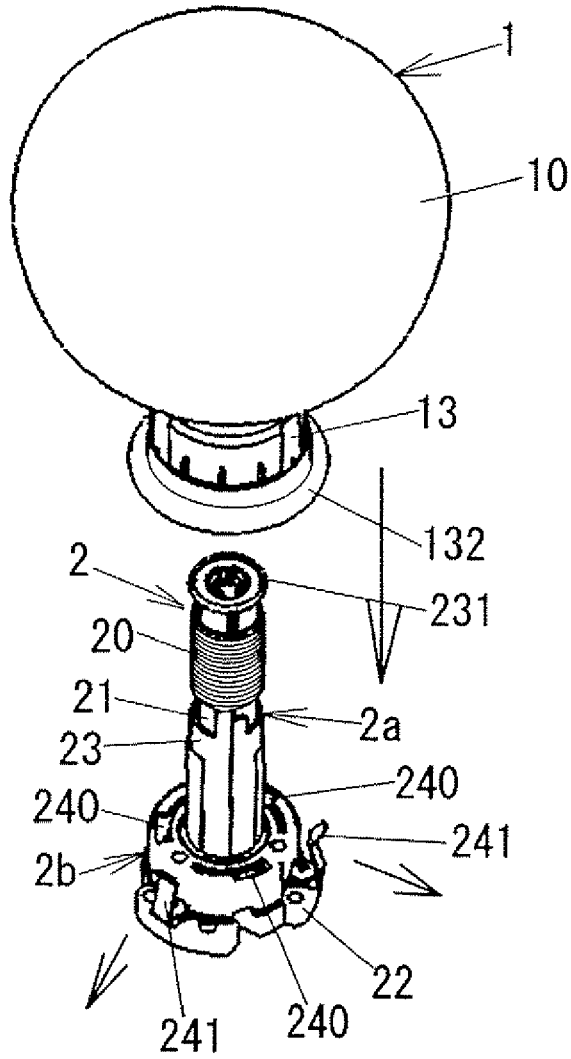
FIG. 3A is a perspective view showing a manner that the lamp unit is mounted to the power coupler unit in the electrodeless discharge lamp according to the first embodiment.

Subsequently, attaching operation of the lap unit 1 to the power coupler unit 2 in the first embodiment is described. First, as shown in FIG. 3A, a worker approaches the coupling member 13 to the flange 231 at the front end of the power coupler unit 2 while holding a portion near the coupling member 13 of the lamp unit 1, so that the flange 231 provided at the front end of the main body 230 of the bobbin 23 comes in contact with the opening 11*b* (see FIG. 1) of the cavity 11 in the bulb 10, and thereby, positions them. When the front end of the main body 230 of the bobbin 23 is fitted to the opening 11*b* of the cavity 11 in the bulb 10, the lamp unit 1 is moved slowly from the position toward the power coupler unit 2, so that the main body 230 of the bobbin 23 (insertion portion 2*a* of the power coupler unit 2) is gradually inserted relatively into the cavity 11.

Eventually, the outward flange 132 of the coupling member 13 comes in contact with the second inclined surface 241*c* of the elastic member 241 to push the second inclined surface 241, outwardly. When the outward flange 132 climbs over the second inclined surface 241*c*, the outward flange 132 fits to the inside of the first inclined surface 241*b* of the elastic member 241. Since the load suddenly decreases at the time, a feeling that the elastic member 241 climbing over the second inclined surface 241*c* can be transmitted to a hand of the worker.

Since it is less likely that the engaging protrusion 131 of the coupling member 13 faces the first slot portion 240*a* of the opening 240 in the mounting member 24, the engaging protrusion 131 usually comes in contact with the end face 24*a* of the mounting member 24 to be stopped once. Then, by slowly turning the lamp unit 1 in clockwise direction, the engaging protrusion 131 can be fitted into the first slot portion 240*a* of the opening 240. At the time, the lamp unit 1 suddenly moves, though it is slight, toward the power coupler unit 2, so that the feeling that the engaging protrusion 131 is fitted into the first slot portion 240*a* of the opening 240 can be transmitted to the hand of the worker. Finally, the lamp unit 1 is slowly turned in clockwise direction while the engaging protrusion 131 is fitted into the first slot portion 240*a* of the opening 240. Thereby, the base portion 131*a* of the engaging protrusion 131 is fitted into the second slot portion 240*b* of the opening 240 while the small protrusion 240*c* on the side face of the second slot portion 240*b* is fitted into the recessed portion in the base portion 131*a* of the engaging protrusion 131. Due to a click feeling at the time, the worker can know that the lamp unit 1 has been attached to the power coupler unit 2. Note that, in order to detach the lamp unit 1 from the power coupler unit 2, reverse operation as described above may be performed.

Figure 3B:
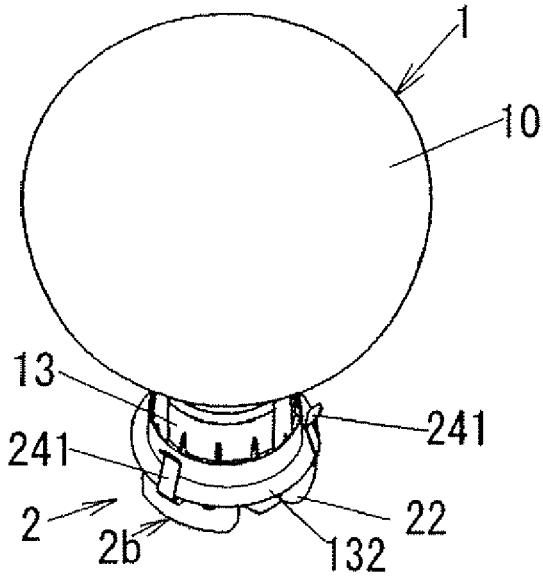
FIG. 3B is a perspective view showing a state after attaching the lamp unit to the power coupler unit.

According to the first embodiment, as shown in FIG. 3B, when the lamp unit 1 is attached to the power coupler unit 2, the elastic members 241 of the power coupler unit 2 presses the outward flange 132 of the coupling member 13 of the lamp unit 1 toward the power coupler unit 2 by elastic force of them while nipping from the outside while biasing it toward the power coupler unit 2 by the elasticity. Therefore, even if the coupling member 13, the mounting member 24, and so on are deteriorated gradually during long-term use due to, for example, environmental conditions, and thereby, looseness, deformation, wear, defect, and so on occur at the respective coupling portions, the holding power sufficient for the weight of the lamp unit 1 is maintained by the elastic member 241.

Specifically, the small protrusion 240*c* on the side face of the second slot portion 240*b* of the opening 240 is most likely to be worn due to vibrations. If the small protrusion 240*c* is worn, the lamp unit 1 may be turned in counterclockwise direction relative to the power coupler unit 2 due to the vibrations. Then, if the engaging protrusion 131 turns to face the first slot portion 240*a* of the opening 240, the lamp unit 1 may be at risk for being detached from the power coupler unit 2 to fall off under its own weight. However, since the coupling member 13 of the lamp unit 1 is pressed toward the power coupler unit 2 by the elastic members 241 as described above, vibrations can be suppressed so that the small protrusion 240*c* is less likely to be worn. Even if the small protrusion 240*c* is worn, the lamp unit 1 is less likely to be turned in counterclockwise direction due to the pressure of the elastic member 241. Furthermore, even if the lamp unit 1 is turned in counterclockwise direction and the engaging protrusion 131 faces the first slot portion 240*a* of the opening 240, the elastic members 241 hold the outward flange 132 of the coupling member 13 from the outside, so that the lamp unit 1 will almost never become detached from the power coupler unit 2 to fall off.

Furthermore, the elastic member 241 is made of the anticorrosion or stainless metal material and further secured by the screw or the like to the heat conduction member 22 made of the anticorrosion or stainless metal material. Therefore, unlike a member made of a resin, the deterioration due to temperature changes, ultraviolet radiation, vibrations, and so on is very small even after long-term use. Still furthermore, the elastic members 241 made of the metal material are provided in a vicinity of the position farthest from the coil 20 and the core 21 for generating a high-frequency electromagnetic field so as to be less likely to be affected by an electric field or a magnetic field generated by the coil 20. Accordingly, it is also unlikely that the elastic member 241 deteriorates due to an electric or magnetic field.

In addition, attaching or detaching operation of the lamp unit 1 to or from the power coupler unit 2 contains only by aligning the rotational symmetry axis of the bulb 10 of the lamp unit 1 with the axis of the bobbin 23 of the power coupler unit 2, and turning the lamp unit about the axes and moving it forward/backward in the direction of the axes, so that it can be performed even by touch. Therefore, an electrodeless discharge lamp suitable for use at a place where environmental conditions are unfavorable and lamp replacement is difficult can be provided.

Second Embodiment

Subsequently, an electrodeless discharge lamp in accordance with a second embodiment of the present invention is described with reference to FIG. 4 to FIG. 7. A basic configuration of the electrodeless discharge lamp in accordance with the second embodiment is similar to that of the above described first embodiment but different at the following points.

Figure 4:
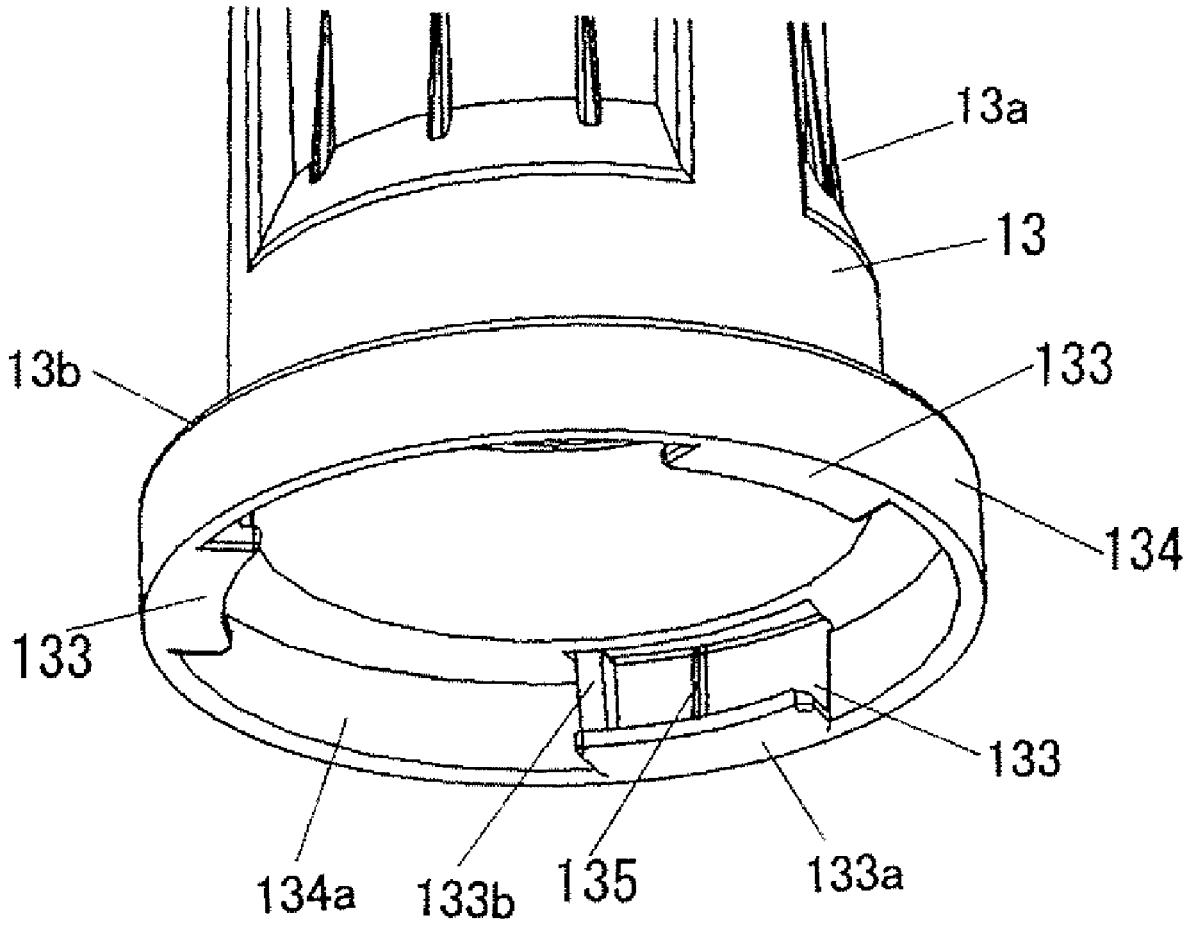
FIG. 4 is a perspective view showing a configuration in a vicinity of a coupling member of a lamp unit in an electrodeless discharge lamp in accordance with a second embodiment of the present invention.
Figure 7:
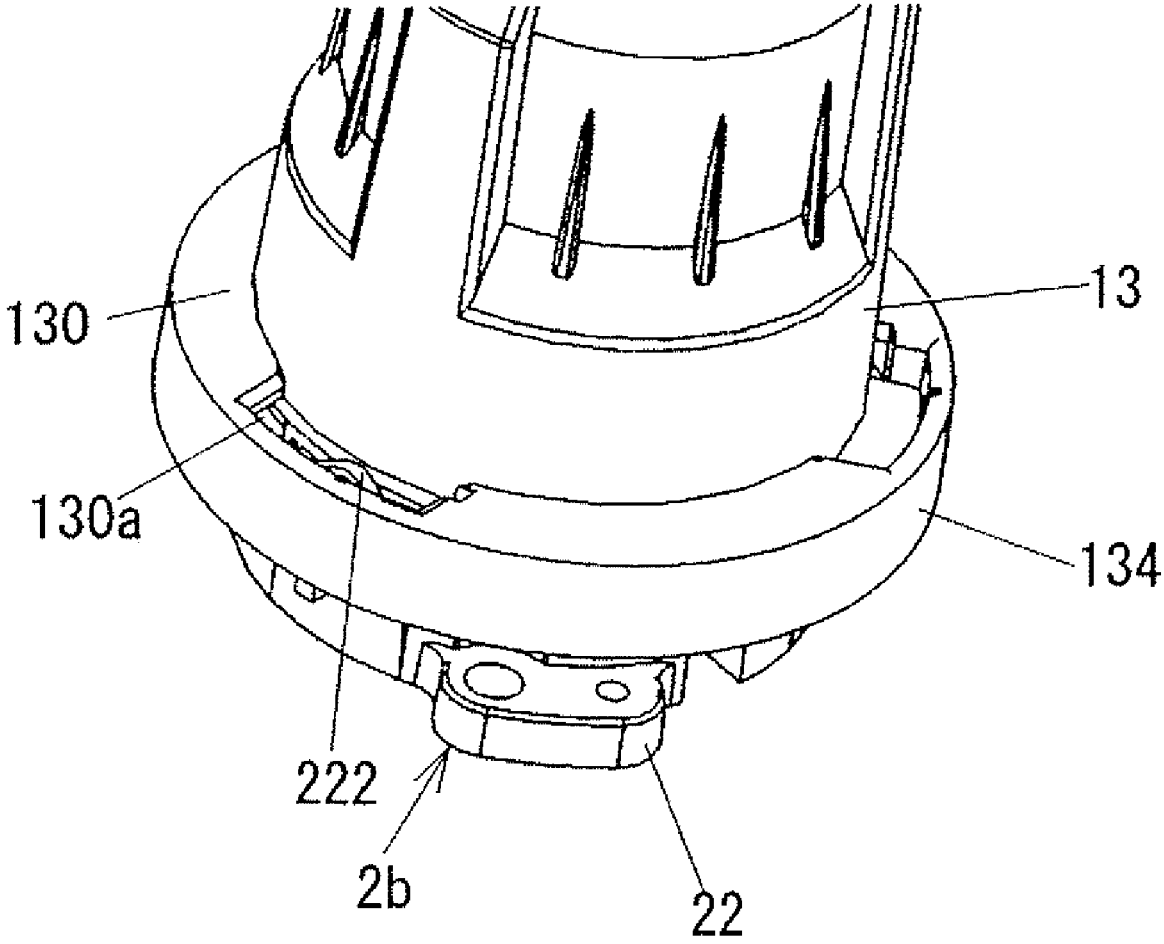
FIG. 7 is a perspective view showing a state after attaching the lamp unit to the power coupler unit in the electrodeless discharge lamp in accordance with the second embodiment.

As shown in FIG. 4 and FIG. 7, no outward flange 132 is provided on a second cylindrical portion 13*b* of a coupling member 13 which has a larger inner and outer diameters, but a plurality of coupling portions 133 is formed to extend inward from an inner surface 134*a* of a cylindrical side wall 134 of the second cylindrical portion 13*b*. Specifically, a plurality of arc-shaped protrusions (first coupling portions) 133*a* is formed at a given angular interval so as to protrude inward from substantially the same surface as an end of the second cylindrical portion 13*b* at a power coupler unit 2 side. Furthermore, a stopper 133*b* formed in an axial direction of the second cylindrical portion 13*b* is provided at a position opposite to one end of each of the arc-shaped protrusions 133*a* on an inner surface 134*a* of the cylindrical side wall 134. Still furthermore, a claw-shaped protrusion 135 is formed at a position opposite to the center of each of the arc-shaped protrusions 133*a* on the inner surface 134*a* of the cylindrical side wall 134. Still furthermore, as shown in FIG. 7, a fitting hole 130*a* is formed at a position opposite to each of the arc-shaped protrusions 133*a* on an inward flange 130.

Figure 5:
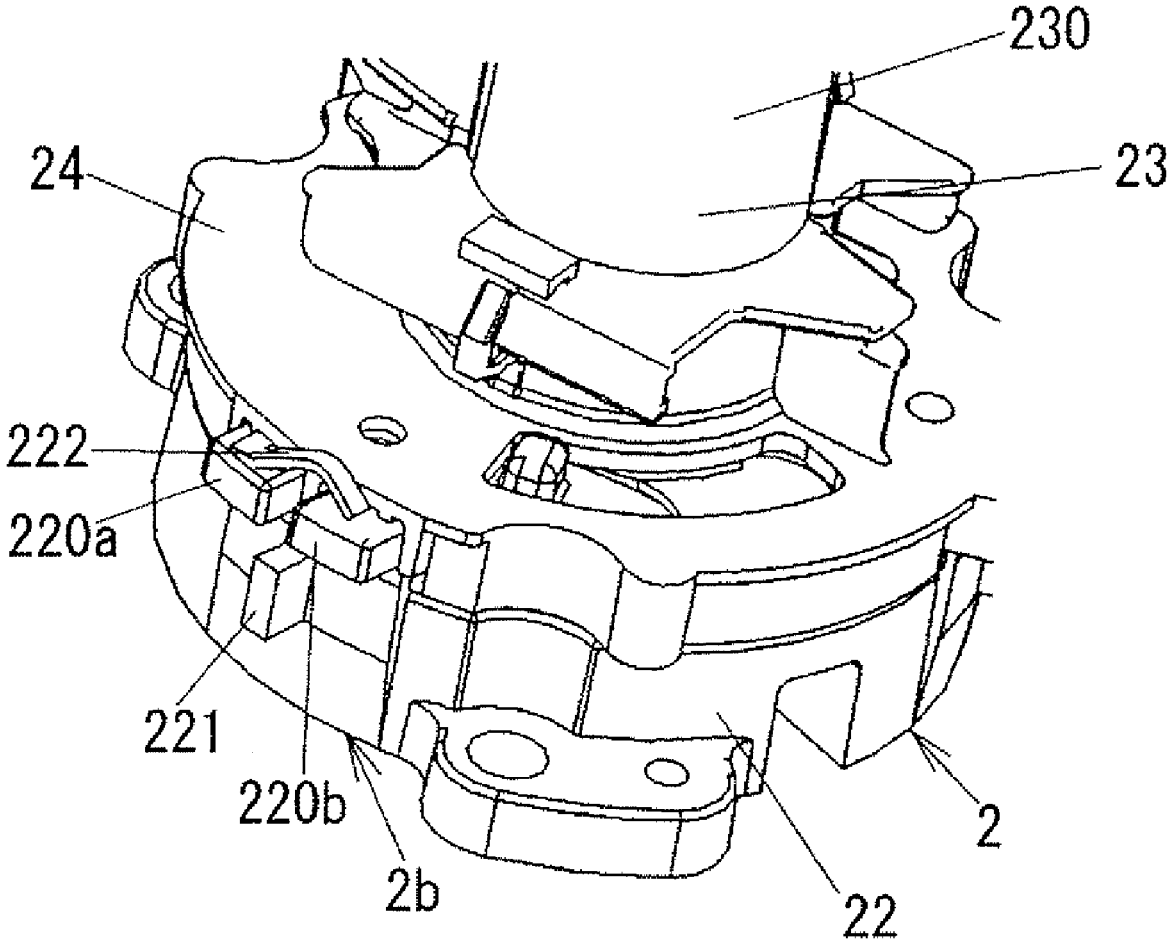
FIG. 5 is a perspective view showing a configuration of a base portion of a power coupler unit in the electrodeless discharge lamp in accordance with the second embodiment.

On the other hand, as shown in FIG. 5, a plurality of pairs of protrusions (second coupling portions) 220*a* and 220*b* and protrusions (second coupling portions) 221 formed at a position between the protrusions 220*a* and 220*b* and opposite to the bobbin 23 with respect to the side of the protrusions 220*a* and 220*b* are formed on a heat conduction member 22 so as to protrude outwardly in a radial direction with respect to the central axis of the main body 230 of the bobbin 23. Furthermore, an elastic member 222 formed so as to protrude toward the main body 230 of the bobbin 23 is provided between the protrusions 220*a* and 220*b*. Specifically, a first end of the elastic member 222 is fixed on the protrusion 220*a* and a second end is not fixed on the protrusion 220*b* to be a free end. The heat conduction member 22 and the elastic member 222 are made of an anticorrosion or a stainless metal material, similar to those of the above described first embodiment. Furthermore, the elastic member 222 is made of a material resistant to metal fatigue so as to have a function as a plate spring. Specifically, a plurality of the elastic members 222 is provided radially with respect to the central axis of the bobbin 23, so that they can be elastically deformed in a plane parallel to the central axis of the bobbin 23, and thereby being fitted to the fitting holes 130*a* formed on the coupling member 13 due to elasticity thereof.

In the second embodiment, the arc-shaped protrusions 133*a* of the coupling member 13 are held between the protrusions 220*a* and 220*b* and the protrusions 221 of the heat conduction member 22, and the claw-shaped protrusions 135 of the coupling member 13 are held between the protrusions 220*a* and 220*b* of the heat conduction member 22. Furthermore, the elastic members 222 are fitted to the fitting holes 130*a* in the coupling member 13. Thereby, the coupling member 13 is less likely to be detached from the heat conduction member 22.

Subsequently, attaching operation of the lamp unit 1 to the power coupler unit 2 in the second embodiment is described with reference to FIG. 6A to FIG. 6E. FIG. 6A to FIG. 6E show cross sections of outer portion of the coupling member 13 as viewed from the center of the cylindrical portion of the coupling member 13. In addition, the processes until the main body 230 of the bobbin 23 of the power coupler unit 2 (insertion portion 2*a* of the power coupler unit 2) is gradually inserted relatively into a cavity 11 in a bulb 10 of the lamp unit 1 is similar to those in the above described first embodiment, so that description of them is omitted.

Figure 6A:
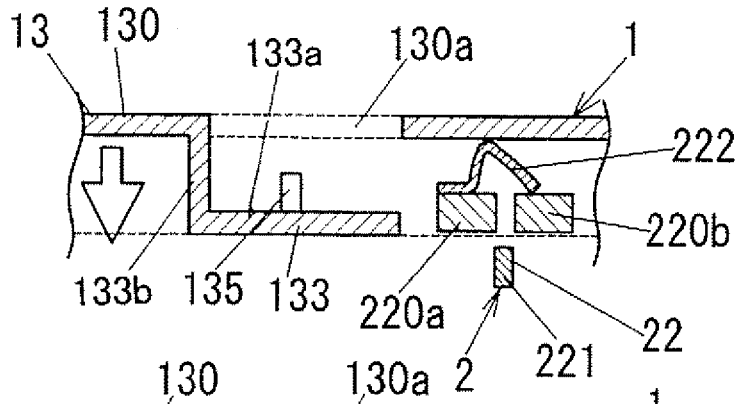
FIGS. 6A to 6E are cross sectional views showing operation for attaching the lamp unit to the power coupler unit in the electrodeless discharge lamp in accordance with the second embodiment, respectively.
Figure 6B:
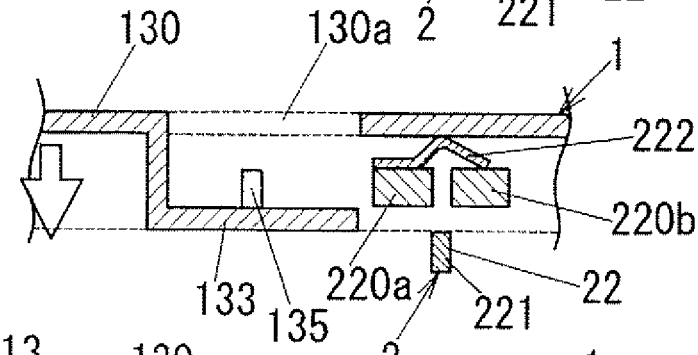
Figure 6C:
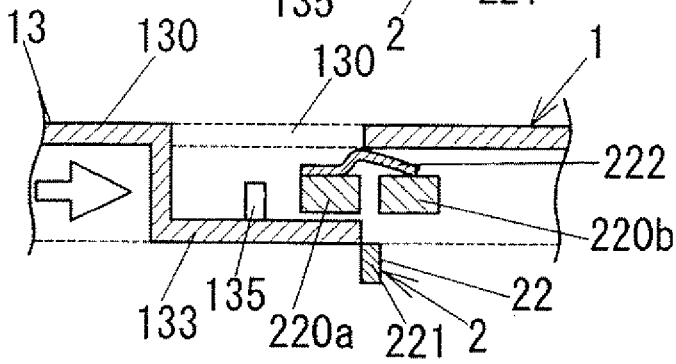
Figure 6D:
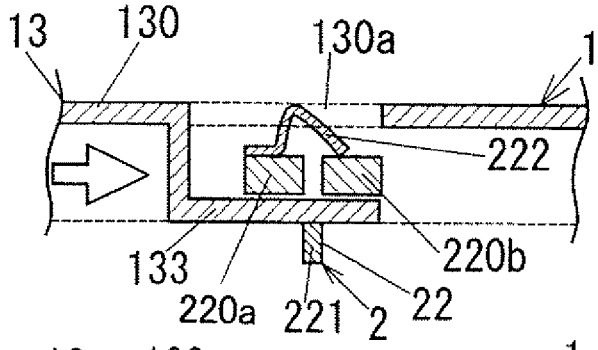
Figure 6E:
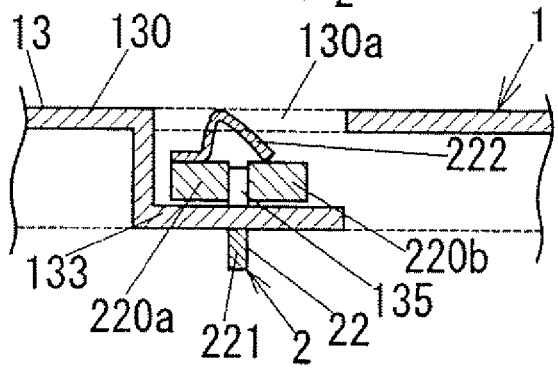

In the case of the second embodiment, when the main body 230 of the bobbin 23 is gradually inserted relatively into the cavity 11 in the bulb 10, the arc-shaped protrusions 133*a* of the coupling member 13 come in contact with the elastic members 222 provided on the heat conduction member 22 come, or the inward flange 130 of the coupling member 13 comes in contact with the elastic member 222, as shown in FIG. 6A. In the former case, the lamp unit 1 may be turned so that the elastic members 222 are moved away from the arc-shaped protrusions 133*a* to come in contact with the flange 130. In the state shown in FIG. 6A, since the elastic member 222 is little deformed, if the lamp unit 1 is further turned in that state, the protrusions 220*a* of the heat conduction member 22 come in contact with the arc-shaped protrusions 133*a* of the coupling member 13. Therefore, the lamp unit 1 is further pressed toward the power coupler unit 2 to deform the elastic members 222 as shown in FIG. 6B so that the arc-shaped protrusions 133*a* are brought to the same level as the clearances between the protrusions 220*a* and 220*b* and the protrusions 221. Then, as shown in FIG. 6C, the lamp unit 1 is turned in clockwise direction (to the right in the figure) as viewed from a worker so as to move the arc-shaped protrusions 133*a* into the clearances between the protrusions 220*a* and 220*b* and the protrusions 221. When the lamp unit 1 is further turned, the elastic members 222 are fitted to the fitting holes 130*a*, and they return to the original shape as shown in FIG. 6D. Finally, as shown in FIG. 6E, the claw-shaped protrusions 135 are held between the protrusions 220*a* and 220*b*, and thereby, the lamp unit 1 is attached to the power coupler unit 2. In other words, according to the second embodiment, when the lamp unit 1 is turned relative to the power coupler unit 2 about the central axis of the bobbin 23, the arc-shaped protrusions (first coupling portions) 133*a* are coupled with the protrusions (second coupling portions) 220*a*, 220*b* and 221, and the elastic members 222 are fitted to (engaged with) the fitting holes 130*a* in the coupling member 13, simultaneously.

As described above, according to the configuration of the second embodiment, under the state where the lamp unit 1 is mounted on the power coupler unit 2, the elastic members 222 of the power coupler unit 2 are held in the fitting holes 130*a* formed on the inward flange 130 of the coupling member 13 of the lamp unit 1, and the arc-shaped protrusions 133*a* of the coupling member 13 are held between the protrusions 220*a* and 220*b* and the protrusions 221 of the heat conduction member 22, and furthermore, the claw-shaped protrusions 135 of the coupling member 13 are held between the protrusions 220*a* and 220*b* of the heat conduction member 22. Therefore, even if the claw-shaped protrusions 135 of the coupling member 13 are worn due to vibrations, there is little possibility that the lamp unit 1 turns in counterclockwise direction, because the elastic members 222 are held in the fitting holes 130*a* in the coupling member 13. Further, since a plurality of the arc-shaped protrusions 133*a* formed on the coupling member 13 is held between the protrusions 220*a* and 220*b* and the protrusions 221 at a plurality of positions, the lamp unit 1 will rarely be detached from the power coupler unit 2 to fall off.

Furthermore, the elastic member 222 is made of the anticorrosion or stainless metal material and further fixed on the heat conduction member 22 made of the anticorrosion or stainless metal material. Therefore, unlike a member made of a resin, the deterioration due to temperature changes, ultraviolet radiation, vibrations, and so on is very small even after long-term use. Still furthermore, the elastic members 222 made of the metal material are provided in a vicinity of the position farthest from the coil 20 and the core 21 for generating a high-frequency electromagnetic field so as to be less likely to be affected by an electric field or a magnetic field generated by the coil 20. Accordingly, it is also unlikely that the elastic member 241 deteriorates due to an electric or magnetic field.

In addition, attaching or detaching operation of the lamp unit 1 to or from the power coupler unit 2 contains only by aligning the rotational symmetry axis of the bulb 10 of the lamp unit 1 with the axis of the bobbin 23 of the power coupler unit 2, and turning the lamp unit about the axes and moving it forward/backward in the direction of the axes, so that it can be performed even by touch. Therefore, an electrodeless discharge lamp suitable for use at a place where environmental conditions are unfavorable and lamp replacement is difficult can be provided.

Third Embodiment

Subsequently, an electrodeless discharge lamp in accordance with a third embodiment of the present invention is described with reference to FIG. 8 and FIG. 9. A basic configuration of the electrodeless discharge lamp in accordance with the third embodiment is similar to that of the above described first or second embodiment but different at the following points.

Figure 8:
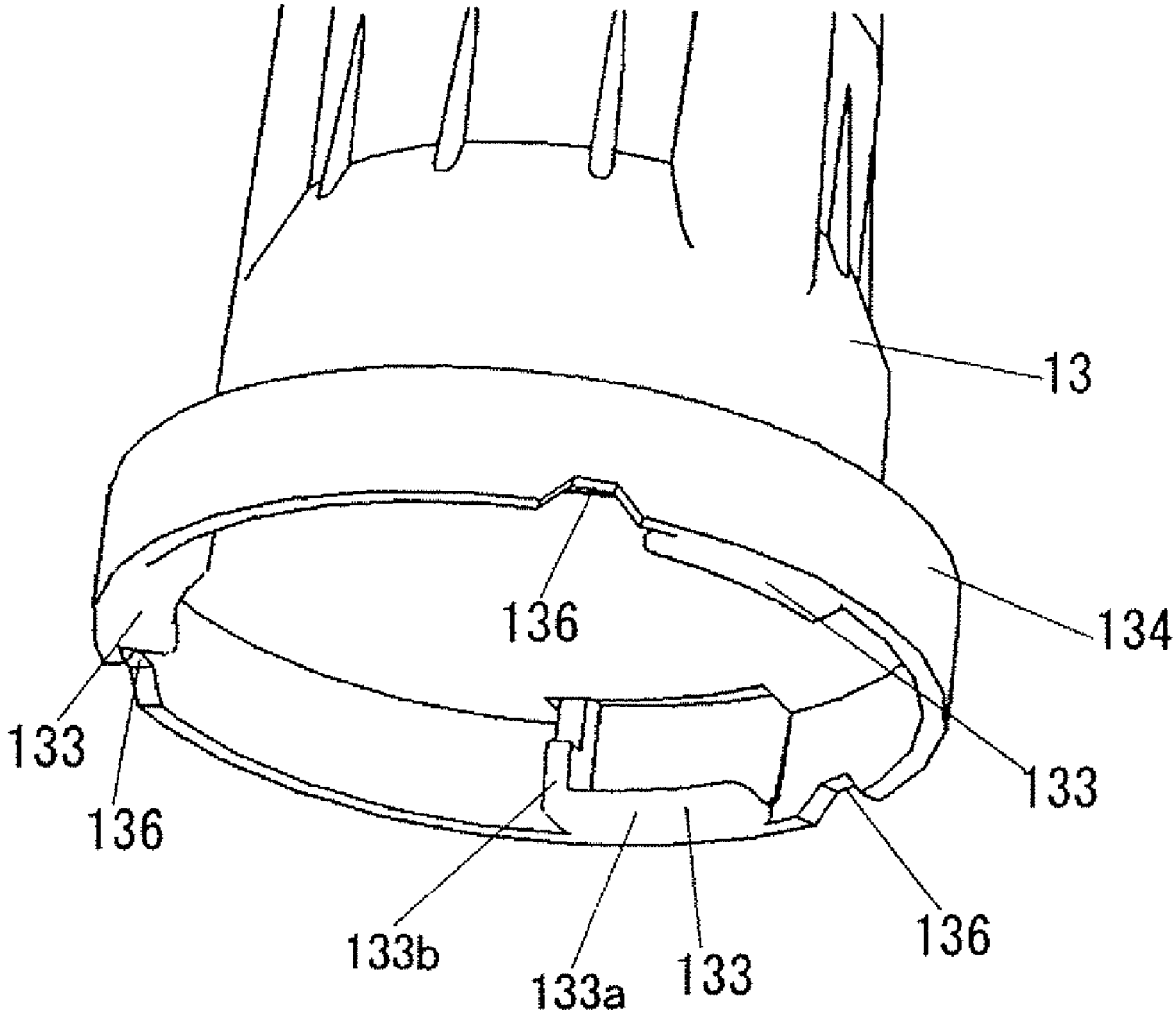
FIG. 8 is a perspective view showing a configuration in a vicinity of a coupling member of a lamp unit in an electrodeless discharge lamp in accordance with a third embodiment of the present invention.

As shown in FIG. 8, a plurality of coupling portions 133 is formed to extend inward from an inner surface 134*a* of a cylindrical side wall 134 of a second cylindrical portion 13*b* having larger in inner and outer diameters among a coupling member 13. Specifically, a plurality of arc-shaped protrusions (first coupling portions) 133*a* is formed at a predetermined angular interval so as to protrude inward from substantially the same surface as an end of a second cylindrical portion 13*b* at a power coupler unit 2 side. Furthermore, a stopper 133*b* formed in an axial direction of the second cylindrical portion 13*b* is provided at a position on an inner surface 134*a* of the cylindrical side wall 134 opposite to an end of each of the arc-shaped protrusions 133*a*. Still furthermore, a notch (fitting recess) 136 is provided at a position adjacent to each of the arc-shaped protrusions 133*a* of the cylindrical side wall 134 of the second cylindrical portion 13*b*.

Figure 9:
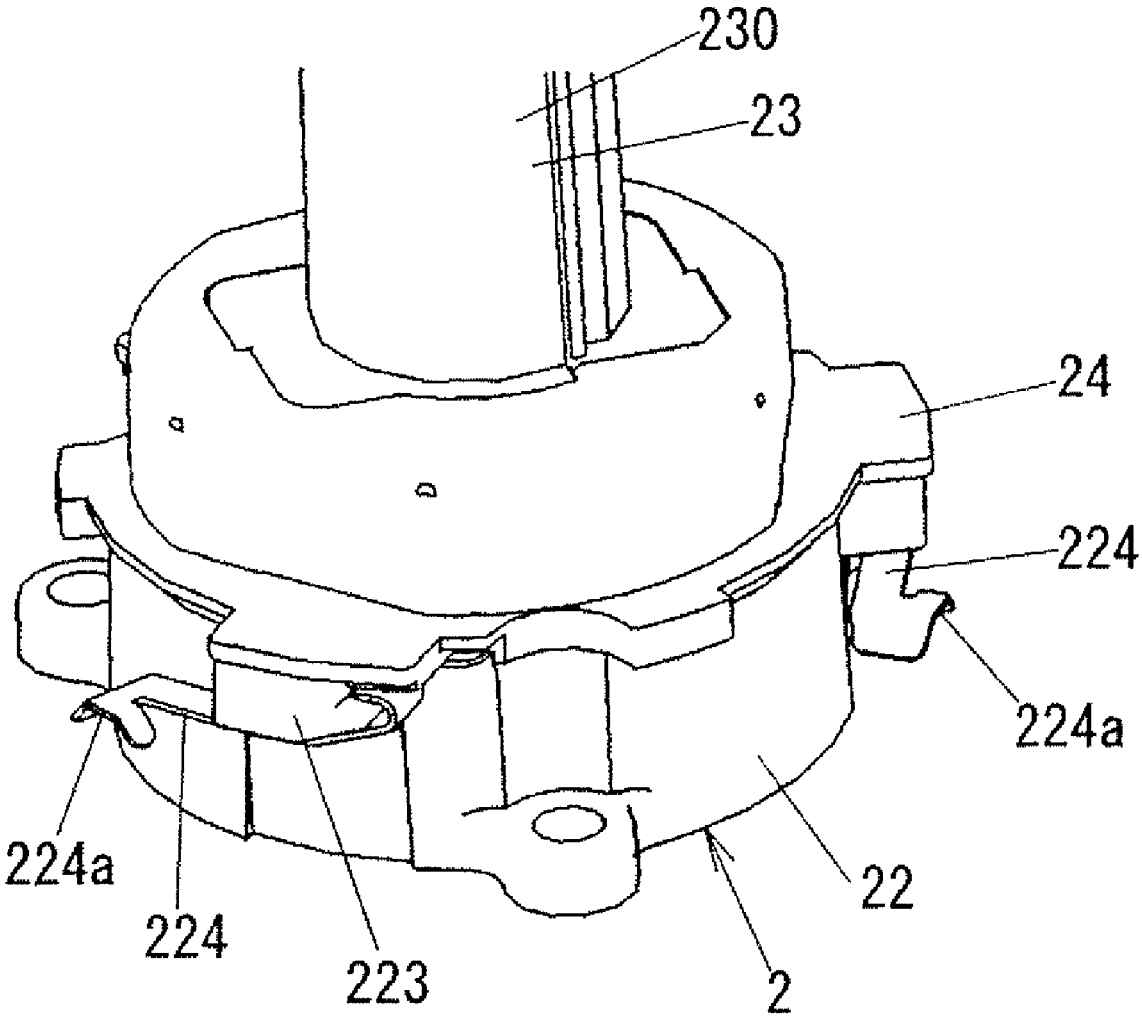
FIG. 9 is a perspective view showing a configuration of a base portion of a power coupler unit in the electrodeless discharge lamp in accordance with the third embodiment.

As shown in FIG. 9, a plurality of protrusions 223 is provided on a heat conduction member 22 each to protrude outward in a radial direction with respect to a central axis of a main body 230 of a bobbin 23. Furthermore, a first end of an elastic member 224 which is formed to protrude in a circumferential direction with respect to the central axis of the main body 230 of the bobbin 23 is fixed on each of the protrusions 223. A second end 224*a* of the elastic member 224, which is a free end, is formed to be substantially crest-shaped so as to engage with the notch 136 of the second cylindrical portion 13*b* of the coupling member 13 described above and to press the coupling member 13 in a direction opposite to the power coupler unit 2. The heat conduction member 22 and the elastic member 224 are made of an anticorrosion or a stainless metal material, like those in the above described first or second embodiment. Still furthermore, the elastic member 224 is made of a material resistant to metal fatigue so as to function as a plate spring. In other words, the elastic members 224 are provided at a plurality of positions at a predetermined angular interval on a circumference of a circle centered on the central axis of the bobbin 23, a first end thereof is fixed on the protrusion 223 formed to protrude radially from the heat conduction member 22 with respect to the central axis of the bobbin 23, a second end 224*a* thereof protrudes tangentially to a circle centered on the central axis of the bobbin 23, and a protrusion which engages with the notch (fitting recess) 136 is formed on the second end 224*a*.

Subsequently, attaching operation of the lamp unit 1 to the power coupler unit 2 in the third embodiment is described. Note that processes until the main body 230 of the bobbin 23 of the power coupler unit 2 (insertion portion 2*a* of the power coupler unit 2) is gradually inserted relatively into a cavity 11 in a bulb 10 of the lamp unit 1 is similar to those in the above described first embodiment, so that description of them is omitted.

In the case of the third embodiment, when the main body 230 of the bobbin 23 is gradually inserted relatively into the cavity 11 in the bulb 10, the arc-shaped protrusions 133*a* of the coupling member 13 come in contact with the protrusions 223 of the heat conduction member 22, or an inward flange 130 of the coupling member 13 comes in contact with the protrusions 223. In the former case, the lamp unit 1 may be turned to move the arc-shaped protrusions 133*a* away from the protrusions 223 and bring the flange 130 into contact with the protrusions 223. In a state where the inward flange 130 of the coupling member 13 contacts with the protrusions 223, the second ends 224*a* of the elastic members 224 contact with the end face of the cylindrical side wall 134 of the second cylindrical portion 13*b* of the coupling member 13. Then, the lamp unit 1 is turned in clockwise direction (to the right in the figure) as viewed from a worker so that the protrusions 223 of the heat conduction member 22 enter into the spaces between the arc-shaped protrusions 133*a* and the inward flange 130 of the coupling member 13. When the lamp unit 1 is further turned, the second ends 224*a* of the elastic members 224 slide on the end face of the cylindrical side wall 134 to be fitted to the notches 136 in the coupling member 13. At this time, an impact and/or a sound occur/occurs due to sudden deformations of the elastic members 224, and thereby, the worker can know that the lamp unit 1 has been attached to the power coupler unit 2. In other words, by turning the lamp unit 1 relative to the power coupler unit 2 about the central axis of the bobbin 23, the arc-shaped protrusions (first coupling portions) 133*a* are coupled with the protrusions 223 and the first ends of the elastic members 224, and the elastic members 224 are engaged with the notches (fitting recesses) 136 of the coupling member 13, simultaneously. Note that, in the third embodiment, the protrusions 223 and the first ends of the elastic members 224 serve as second coupling portions.

As described above, according to the configuration of the third embodiment, under a state where the lamp unit 1 is attached to the power coupler unit 2, the protrusions 223 of the heat conduction member 22 of the power coupler unit 2 are held between the arc-shaped protrusions 133*a* and the inward flange 130 of the coupling member 13, as well as the elastic members 224 of the power coupler unit 2 are held in the notches 136 in the second cylindrical portion 13*b* of the coupling member 13 of the lamp unit 1. Furthermore, the coupling member 13 is pressed in a direction opposite to the power coupler unit 2 by the elasticity of the elastic members 224. Therefore, even if vibrations are applied, the lamp unit 1 is rarely turned in counterclockwise direction. Still furthermore, since the protrusions 223 of the heat conduction member 22 of the power coupler unit 2 are held between the arc-shaped protrusions 133*a* and the inward flange 130 of the coupling member 13, the lamp unit 1 is rarely detached from the power coupler unit 2 to fall off.

Furthermore, the elastic member 224 is made of the anticorrosion or stainless metal material and further fixed on the heat conduction member 22 made of the anticorrosion or stainless metal material. Therefore, unlike a member made of a resin, the deterioration due to temperature changes, ultraviolet radiation, vibrations, and so on is very small even after long-term use. Still furthermore, the elastic members 224 made of the metal material are provided in a vicinity of the position farthest from the coil 20 and the core 21 for generating a high-frequency electromagnetic field so as to be less likely to be affected by an electric field or a magnetic field generated by the coil 20. Accordingly, it is also unlikely that the elastic member 241 deteriorates due to an electric or magnetic field.

in addition, attaching or detaching operation of the lamp unit 1 to or from the power coupler unit 2 contains only by aligning the rotational symmetry axis of the bulb 10 of the lamp unit 1 with the axis of the bobbin 23 of the power coupler unit 2, and turning the lamp unit about the axes and moving it forward/backward in the direction of the axes, so that it can be performed even by touch. Therefore, an electrodeless discharge lamp suitable for use at a place where environmental conditions are unfavorable and lamp replacement is difficult can be provided.

Fourth Embodiment

Subsequently, an electrodeless discharge lamp in accordance with a fourth embodiment of the present invention is described with reference to FIG. 10 to FIG. 13. A basic configuration of the electrodeless discharge lamp in accordance with the fourth embodiment is similar to that of the above described first to third embodiments but different at the following points.

Typically, a bulb 10 is formed into a predetermined shape while glass is softened by heating, so that the processing accuracy is lower and thus the dimension error is larger in comparison with metal processing or resin molding. Therefore, it is designed to have a large dimensional tolerance between an outer diameter of a coil portion of a power coupler unit 2 and an inner diameter of a cavity 11 of the bulb 10. However, when it is used at a place with heavy vibrations such as a road or an iron bridge, there is a high possibility that the coil portion of the power coupler unit 2 set in the cavity 11 of the bulb 10 collides with the side wall of the cavity 11 to break the bulb 10. Especially, in a case where an air pipe 12 is provided at the center of the cavity 11 of the bulb 10, the possibility of breakage of the bulb 10 increases.

Figure 11:
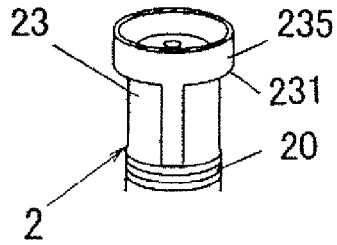
FIG. 11 is a perspective view showing a configuration of part of a power coupler unit in the electrodeless discharge lamp in accordance with the fourth embodiment.
Figure 12:
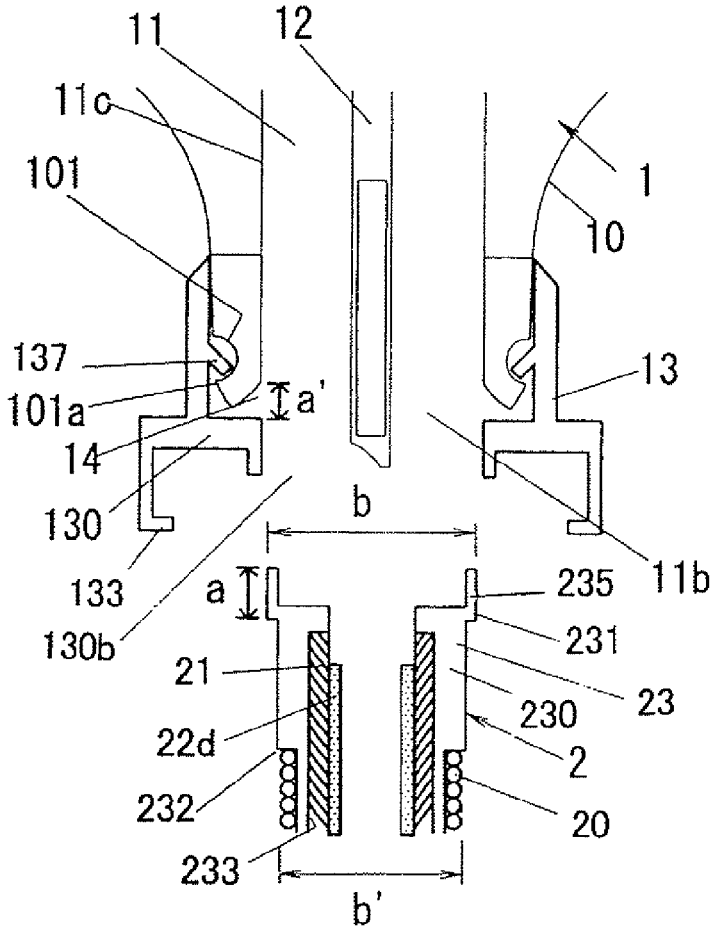
FIG. 12 is a cross sectional view showing relationships between sizes in a vicinity of a coupling portion and a cavity of a bulb of a lamp unit and sizes in a vicinity of a cavity a front end portion of a bobbin of a power coupler unit in the electrodeless discharge lamp in accordance with the fourth embodiment.

In view of that, as shown in FIG. 1 or FIG. 2, in the first embodiment, the circular flange 231 is formed at the front end of the main body 230 of the bobbin 23 so as to protrude outward in the direction perpendicular to the central axis of the cylindrical main body 230. Then, by setting the outer diameter of the flange 231 smaller by the predetermined tolerance than the diameter of the inner surface of the cavity 11 of the bulb 10 facing the air pipe 12, a misalignment between the central axis of the cavity 11 and the central axis of the power coupler unit 2 is decreased. In the fourth embodiment, as shown in FIG. 10 to FIG. 12, a cylindrical guide wall 235 is further provided to protrude from the outermost periphery of a flange 231 toward a lamp unit 1 in a direction parallel to the central axis of a power coupler unit 2, and enabling insertion of a main body 230 of a bobbin 23 into a cavity 11 of a bulb 10 easier.

A groove 101, which is to be engaged with a hook 137 formed on a peripheral surface of a first cylindrical portion 13*a* of a coupling member 13, is formed around the coupling portion of the bulb 10. The groove 101 is processed so that a length "t" from a bulb top 10*b* to an end 101*a* of the groove 101 is uniform. However, for the length x from the end 101*a* to a sealed portion 100, a predetermined range of tolerance is generally allowed in view of the mass productivity. It would be ideal that the length x is equal to a distance D from the end 101*a* of the groove 101 to an inward flange 130 of the coupling member 13. In such a case, a gap 14 between the inward flange 130 of the coupling member 13 and the sealed portion 100 of the bulb 10 becomes the smallest. However, when the length x becomes longer than the distance D, the groove 101 and the hook 137 cannot be engaged, so that the length x is designed to be shorter than the distance D, in view of the above described tolerance.

Hooks 137 protrude inward from a plurality of positions on an inner peripheral surface of the first cylindrical portion 13*a* of the coupling member 13 (for example, positions that divide the inner circumference into three equal parts), so that it will be coupled integrally with the bulb 10 when it is engaged with the groove 101 of the bulb 10. In addition, an adhesive will be filled between a gap between the groove 101 and the hook 137 so that the bulb 10 and the coupling member 13 are firmly fixed to each other, if needed.

Figure 10:
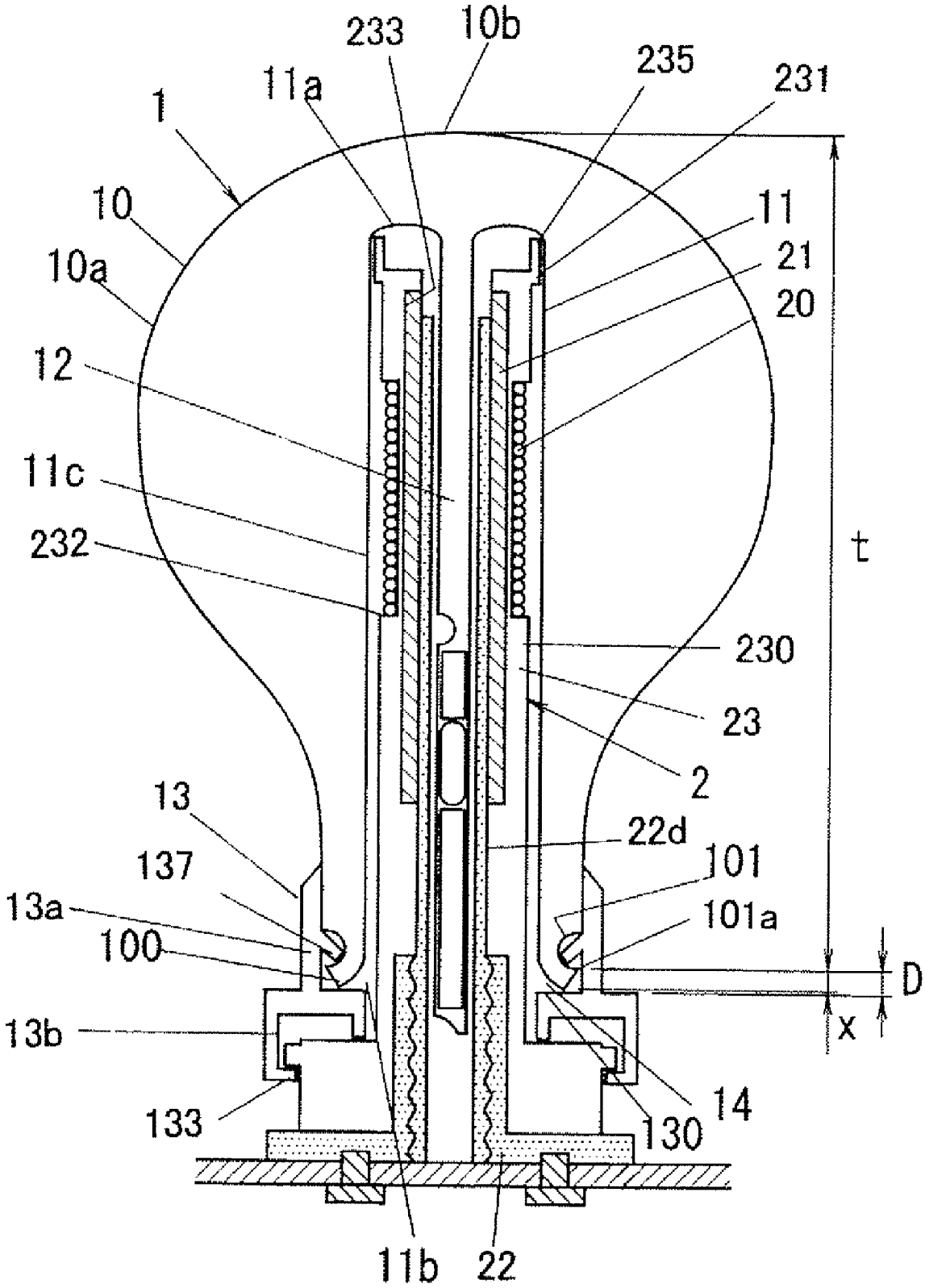
FIG. 10 is a cross sectional view showing a configuration of an electrodeless discharge lamp in accordance with a fourth embodiment of the present invention.

In the configuration example shown in FIG. 10, a structure of attachment of the lamp unit 1 and the power coupler unit 2 is conformed of that in the above described second embodiment, so that illustration of it is omitted. However, the structure is not limited to that, so that it may be conformed of that in the first embodiment or in the third embodiment.

FIG. 12 shows shapes and dimensions of the bobbin 23 in the vicinity of the lamp unit side. It is designed that the outer diameter "b" of the flange 231 becomes larger than the outer diameter "b'" of a coil 20 (b>b'), and a protruding quantity "a" of the protrusion of the cylindrical guide wall 235 from the flange 231 in the axial direction becomes longer than a maximum dimension "a'" of the above described gap 14 in the axial direction (a>a').

Figure 13:
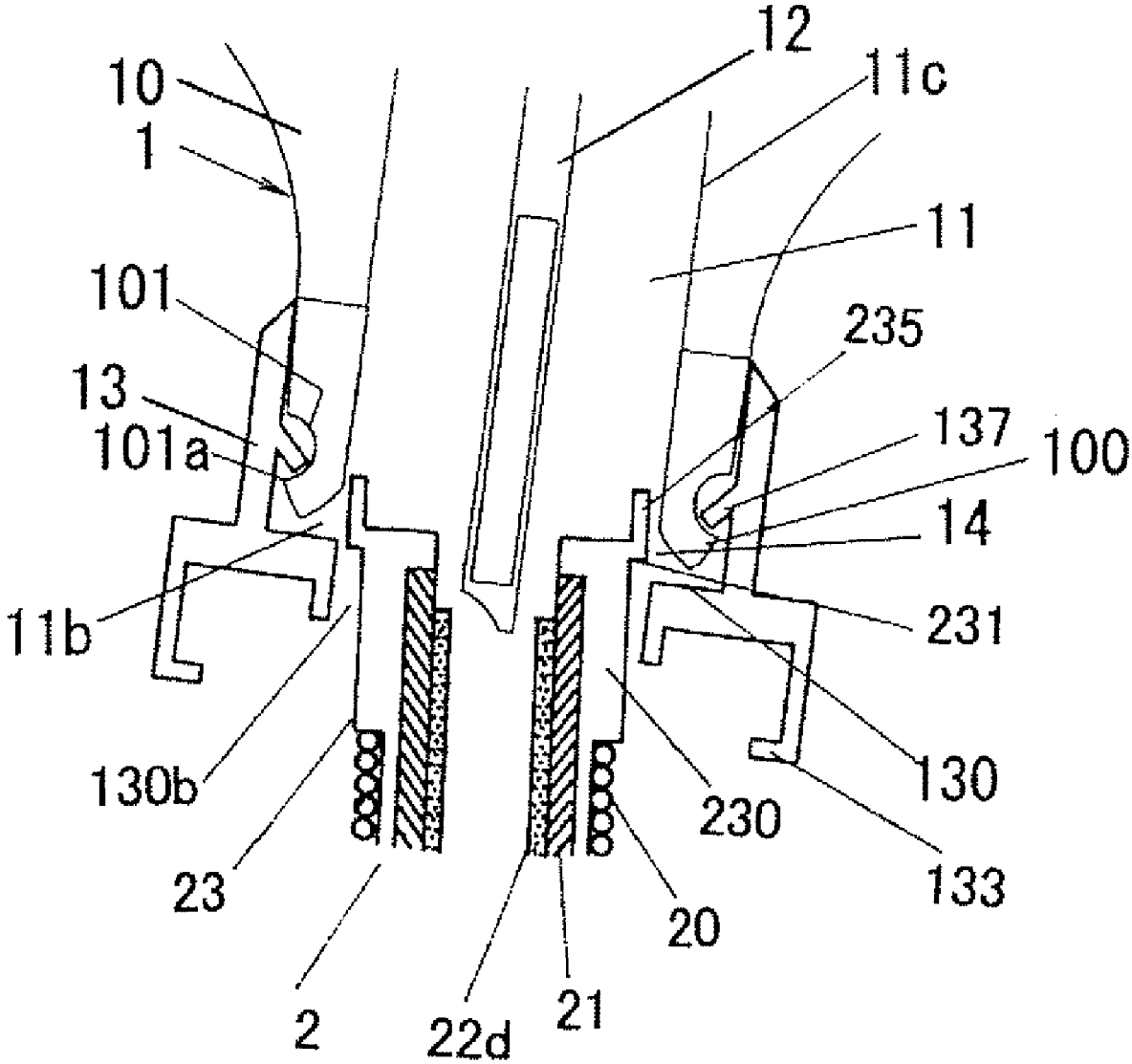
FIG. 13 is a cross sectional view showing operations for attaching the lamp unit to the power coupler unit in the electrodeless discharge lamp in accordance with the fourth embodiment.
Figure 14:
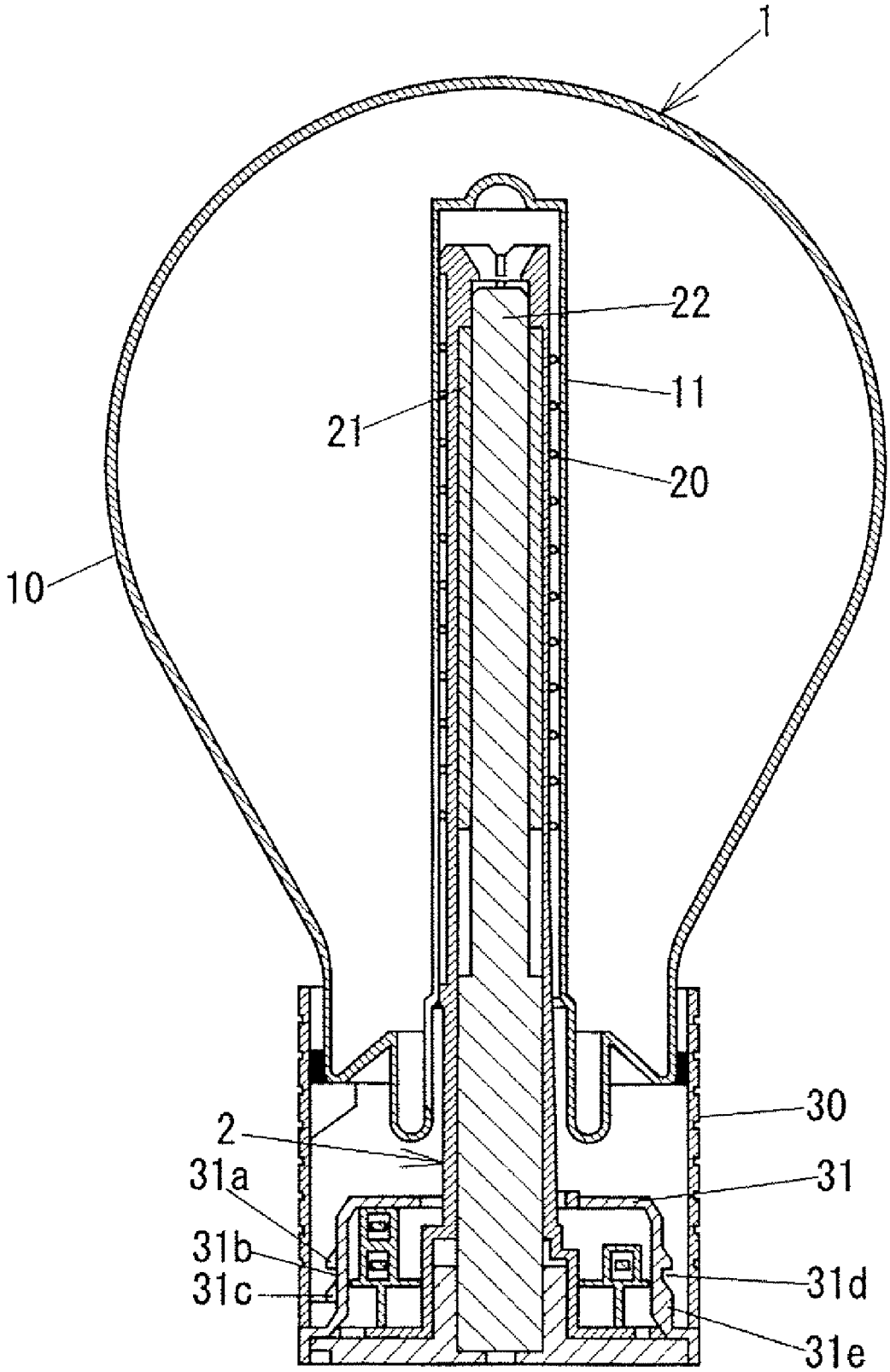
FIG. 14 (PRIOR ART)
FIG. 14 is a cross sectional view showing a configuration of a conventional electrodeless discharge lamp.

With such a configuration, as shown in FIG. 13, when the main body of the bobbin 23 is tried to be inserted into the cavity 11 of the bulb 10, the cylindrical guide wall 235 serves as a guide so that the outer peripheral surface of the guide wall 235 comes in contact with a circular opening 130*b* at the center of the inward flange 130 of the coupling member 13, and thereby, the rotational symmetry axis of the bulb 10 cannot take a relative angle so large with respect to the central axis of the main body of the bobbin 23. Therefore, the edge at the front end of the circular protrusion 235 rarely enters into the gap 14 between the inward flange 130 of the coupling member 13 and the sealed portion 100 of the bulb 10. Consequently although the length of the main body 230 of the bobbin 23 becomes longer than that in the first embodiment, the main body 230 of the bobbin 23 can be inserted into the cavity 11 of the bulb 10, much smoother. Furthermore, since a large force is not needed when the main body 230 of the bobbin 23 is inserted into the cavity 11 of the bulb 10, the possibility that an excessive force is applied to an air pipe 12 is reduced, thereby enabling the prevention of a breakage of the bulb 10.

Still furthermore, since the outer diameter "b" of the cylindrical guide wall 235 is larger than the outer diameter "b'" of the coil 20, the bulb 10 may not contact the coil 20 when the lamp unit 1 is inserted onto the power coupler unit 2, thereby enabling to protect the coil 20 from damage.

In addition, according to the fourth embodiment, it is suitable for the use at a position where the replacement of the lamp is difficult when at least the flange 231 at the front end of the main body 230 of the bobbin 23 and the cylindrical guide wall 235 protruding from the outermost periphery of the flange 231 toward the lamp unit 1 in the direction parallel to the central axis of the power coupler unit 2 are comprised, because the workability in replacement of the lamp unit 1 can be improved in comparison with the conventional electrodeless discharge lamp. Therefore, in the fourth embodiment, it is not necessarily comprised of the structure of the attaching portions of the lamp unit 1 and the power coupler unit 2 in any of the first to third embodiment.

This application is based on Japanese patent applications 2004-188769 and 2004-188792 filed in Japan, the contents of which are hereby incorporated by references.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

INDUSTRIAL APPLICABILITY

As described above, according to the present invention, it is possible to provide an electrodeless discharge lamp that is suitable for use at a place where replacement of the lamp unit is difficult while taking advantage of its characteristics including the small size, the high output, and the long operating life.

The invention claimed is:

1. An electrodeless discharge lamp, comprising:

a power coupler; and a lamp assembly detachably attached to said power coupler, wherein:

said lamp assembly includes:

a discharge container made of a light transparent material, with a substantially tubular hollow portion in a vicinity of a central area thereof, into which a discharge gas is filled therein; and a coupler fixed on said discharge container in a vicinity of an opening of said substantially tubular hollow portion, said coupler having a cylindrical portion, a flange being formed proximate an end portion of said cylindrical portion, a first coupling portion being formed on said flange to be coupled with said power coupler; and said power coupler includes:

an electromagnetic field generator fitted into said substantially tubular hollow portion of said discharge container to generate a high-frequency electromagnetic field;

a metallic heat conductor that radiates heat generated by said electromagnetic field generator;

a second coupling portion coupled with said first coupling portion of said coupler; and a plurality of metallic elastic members each provided on protrusions of said metallic heat conductor protruding outward to engage with an outer surface of said cylindrical portion of said coupler to press said coupler toward said power coupler by elastic force thereof, wherein said electromagnetic field generator includes a coil wound around an outer periphery of a substantially cylindrical shaped bobbin, and a core fitted to an inner periphery of said substantially cylindrical shaped bobbin, said electromagnetic field generator being fitted into said substantially tubular hollow portion by moving said lamp assembly toward said power coupler under a state where said substantially tubular hollow portion of said lamp assembly faces said electromagnetic field generator, said first coupling portion and said second coupling portion being coupled by subsequently turning said lamp assembly relative to said power coupler about a central axis of said substantially cylindrical shaped bobbin.

2. The electrodeless discharge lamp of claim 1, wherein said electromagnetic field generator is fitted to said substantially tubular hollow portion and said plurality of metallic elastic members engage an outer surface of said cylindrical portion of said coupler by moving said lamp assembly toward said power coupler with said substantially tubular hollow portion of said lamp assembly facing said electromagnetic field generator.

3. The electrodeless discharge lamp of claim 2, wherein:

said metallic heat conductor has a disc-shaped portion, and said protrusions are formed to protrude outward from said disc-shaped portion, said plurality of metallic elastic members being radially provided with respect to said central axis of said substantially cylindrical shaped bobbin, so as to be elastically deformed in a plane including said central axis of said substantially cylindrical shaped bobbin, and come in contact with said outer surface of said cylindrical portion of said coupler by elasticity thereof.

4. The electrodeless discharge lamp of claim 3, wherein:

said first coupling portion is an engaging protrusion that protrudes from said coupler toward said power coupler under a state that said coupler is coupled with said power coupler, and has a width of a base portion narrower than that of a front end portion, said second coupling portion is an opening having a wide first slot portion through which said engaging protrusion penetrates and a narrow second slot portion that engages with said base portion of said engaging protrusion.

5. An electrodeless discharge lamp, comprising:

a power coupler; and a lamp assembly detachably attached to said power coupler, wherein said lamp assembly includes:

a discharge container made of a light transparent material, with a substantially tubular hollow portion in a vicinity of a central area thereof, into which a discharge gas is filled therein; and a coupler fixed on said discharge container in a vicinity of an opening of said substantially tubular hollow portion and having a plurality of first coupling portions coupled with said power coupler; and said power coupler includes:

an electromagnetic field generator having a coil wound around an outer periphery of a substantially cylindrical shaped bobbin and a core fitted to an inner periphery of said substantially cylindrical shaped bobbin, and being fitted into said substantially tubular hollow portion of said discharge container to generate a high-frequency electromagnetic field, said electromagnetic field generator being fitted into said substantially tubular hollow portion of said discharge container by moving said lamp assembly toward said power coupler under a state where said substantially tubular hollow portion of said lamp assembly faces said electromagnetic field generator;

a metallic heat conductor to radiate heat generated by said electromagnetic field generator;

a plurality of second coupling portions coupled with said plurality of first coupling portions of said coupler, said plurality of first coupling portion and said plurality of second coupling portions being coupled by subsequently turning said lamp assembly relative to said power coupler about a central axis of said substantially cylindrical shaped bobbin; and a plurality of metallic elastic members each provided in a vicinity of a position on said metallic heat conductor that is farthest from said electromagnetic field generator so as to engage with a portion of said coupler other than said plurality of first coupling portions, wherein:

said metallic heat conductor has a plurality of projections each projecting outwardly in a radial direction with respect to said central axis of said substantially cylindrical shaped bobbin at a predetermined angular interval, said plurality of metallic elastic members being provided on respective projections of said plurality of projections to project in a circumferential direction with respect to said central axis of said substantially cylindrical shaped bobbin, said coupler has one of a plurality of fining holes and fitting recesses formed at portions proximate an end thereof facing said power coupler at said predetermined angular interval, into which one of free ends and a mid portion between said free end and a fixed portion of said plurality of metallic elastic members are fitted by elasticity thereof, by turning said lamp assembly relative to said power coupler about said central axis of said substantially cylindrical shaped bobbin, said first coupling portion and said second coupling portion are coupled with each other and said plurality of metallic elastic members are simultaneously fitted to said one of said plurality of fitting holes and fitting recesses of said coupler.

6. The electrodeless discharge lamp of claim 5, wherein:

said coupler has a substantially cylindrical shaped portion and a flange provided at a predetermined position with respect to an end at said power coupler, said plurality of fitting holes being formed on said flange, each of said plurality of metallic elastic members has a first end portion fixed on said projection and a second end portion which protrudes in a tangential direction of a circle centered on said central axis of said substantially cylindrical shaped bobbin, a mid portion between said first free end and said first fixed end engages with said one of said plurality of fitting holes.

7. The electrodeless discharge lamp of claim 6, wherein:

said plurality of first coupling portions are formed on an inner surface of a cylindrical side wall of said cylindrical portion in a vicinity of said fitting recess; and said plurality of second coupling portions protrude radially with respect to said central axis of said substantially cylindrical shaped bobbin and said first fixed end of each of said plurality of metallic elastic members fixed on a part of said second coupling portion.

8. The electrodeless discharge lamp of claim 5, wherein:

said coupler has a substantially cylindrical shaped portion, and said fitting recesses are formed on an end face of said cylindrical shaped portion, each of said plurality of metallic elastic members has a first end portion fixed on a respective projection of said plurality of projections, and a second end portion which protrudes in a tangential direction of a circle centered on said central axis of said substantially cylindrical shaped bobbin, a protrusion being formed on said second end portion that engages with one of said fitting recesses.

9. The electrodeless discharge lamp of claim 8, wherein:

said first coupling portions are formed on an inner surface of a cylindrical side wall of said cylindrical portion in a vicinity of said fitting recesses; and said second coupling portion projects a heat conduction member and a portion of one of each of said plurality of metallic elastic members fixed on said projection near said first end portion.

10. The electrodeless discharge lamp of claim 8, wherein said protrusion formed on said second end portion of said plurality of metallic elastic members is substantially crest-shaped to bias a connection member to a side opposite said power coupler.

* * * * *